United States Patent [19]

Barnickle

[11] 4,160,440

[45] Jul. 10, 1979

[54] HEAT EXCHANGER

[76] Inventor: Andrew Barnickle, 608 Gideon Rd., Middletown, Ohio 45042

[21] Appl. No.: 875,325

[22] Filed: Feb. 6, 1978

[51] Int. Cl.[2] ..... F24H 3/02; F23L 11/00; F23N 3/00; F24H 3/00

[52] U.S. Cl. ..... 126/110 R; 126/285 R; 126/285.5; 126/116 R

[58] Field of Search ..... 126/99 D, 110 R, 110 A, 126/106, 108, 109, 116 R, 285 B, 285 R, 285.5; 165/6, 101, 90; 432/219, 223; 237/53

[56] References Cited

U.S. PATENT DOCUMENTS

| | | | |
|---|---|---|---|
| 990,755 | 4/1911 | Lembke | 126/116 R |
| 1,224,700 | 5/1917 | Atherton | 126/116 R |
| 1,676,787 | 7/1928 | Lissauer | 165/90 |
| 3,926,173 | 12/1975 | Jury | 126/110 R |
| 3,930,489 | 1/1976 | Anable | 126/99 R |

*Primary Examiner*—Carroll B. Dority, Jr.
*Assistant Examiner*—Lee E. Barrett
*Attorney, Agent, or Firm*—Edward L. Brown, Sr.

[57] ABSTRACT

An improvement in heat exchangers for hot air furnaces and water heaters. The improvement is a rotating damper having an opening above each flue that momentarily closes off the outlet of each flue in turn. This holding of hot gases provides more time for the transfer of heat before the gases are discharged to a chimney. The damper openings are sized and arranged so that at least one of the flues is open and one or more closed at any particular moment during the cycle. When a particular flue is opened by the rotating damper the held gases which have now cooled are discharged to the chimney and replaced by a new supply of hot gases. When this flue is closed by further rotation of the damper, it becomes a holding chamber for the hot gases. The other flues operate in turn in the same manner.

10 Claims, 19 Drawing Figures

HEAT EXCHANGER

BACKGROUND OF THE INVENTION

The field of the invention is a heat exchanger for furnaces and heaters, including hot air furnaces, heating boilers, and water heaters, more particularly a heat exchanger having an automatic damper control which cyclically retains heated gases for a short period in each flue to allow additional time for transfer of heat before discharging the gases into a smokepipe and thence to a chimney.

The prior art for increasing the efficiency of the heat transfer includes devices to increase the length of travel of the heated gases and the fluid to be heated such as in Jury U.S. Pat. No. 3,926,173; and devices to recover heat from the gases after they have passed into the smokepipe, such as Anable U.S. Pat. No. 3,930,489. Increasing the length of travel of the gases through the heat transfer part of the heater, as in the Jury U.S. Pat. No. 3,926,173 increases the bulk of the heater and interferes with its ability to vent by natural draft even the fumes of a pilot flame. In this invention the objective of heat transfer efficiency is obtained with little or no increase in bulk and the natural draft venting ability of the heater is unimpaired. There is not always room for the smoke pipe heat recovery units, such as Anable U.S. Pat. No. 3,930,489, in cases where the heater is close to the chimney and space is limited. The present invention however is useful in such limited space. It is a new and useful means for recovering more heat from the burning of fuel and thus conserving energy. Another feature of the heater is that the flues taper to a larger width at exit. This taper causes more particles of the air to be heated to wipe against a wall of the flue when rising, thus improving heat transfer. Prior art achieves this objective with sinuous flues which impair natural draft.

SUMMARY OF THE INVENTION

This heat exchanger has a cycling rotary damper which momentarily closes off an exit end of a heat exchanging flue which is carrying hot combustion gases from a combustion area to a smoke pipe. The damper is between the exit end of a plurality of such flues and the smoke pipe. The damper has an opening for each flue and the openings are staggered so that not all of the flues are closed or open at any particular time but an approximately constant total area of flue opening is maintained at all times. The cycling damper may be devised in different forms, one of them being a cylinder, rotating about its axis, having apertures in its sleeve wall, each aperture aligned with the exit end of one flue. An open end of the cylinder is connected to the smoke pipe, thence to a chimney. Each aperture extends over an arc of cylinder circumference. The sum of the arcs equals at least 360 degrees. A gear motor rotates the cylinder. At any one moment the exit of at least one flue is open while the exit of at least one other flue is closed.

In operation, the hot gases from the combustion area flow to and recharge the flue having its exit open to the damper aperture. When the damper rotates to where that flue exit is closed, that flue becomes a holding chamber. When the flue's exit is again opened by the damper's rotation the gases are vented to the smoke pipe and the flue is again recharged completing a cycle. Each flue goes through this cycle sequentially. The holding of the gases is to provide more time for heat transfer to extract more heat from the gases before discharging them to the smoke pipe. The apertures are uniform and equally spaced radially when the flues are equal. The apertures are sized and lapped sufficiently to provide a constant area of open flue. Charging and holding time can be varied by the size of apertures and by changing the output speed of the gearmotor.

It is an object of this invention to conserve energy by extracting more heat from the hot gases as they pass through the heater without forcing the gases through a longer tortuous path and without providing a second heat exchanger for the gases after they reach the smoke pipe.

The word flue is used in this application to mean an opening through the heat exchanger for carrying the hot gases produced by combustion.

In an application of the cycling rotary damper to a forced draft gas-burning hot air furnace, the rotary damper is a cylinder having open ends. The cylinder is interposed above and transverse to the outlet ends of the flues. The sleeve wall of the cylinder is pierced with apertures above the outlet end of each flue. Each aperture extends only part way around cicumference of the sleeve wall and is adjacent to the outlet of its respective flue only when the aperture is at bottom of its rotating path. For the remaining part of its path the sleeve wall's solid part closes off said flue's outlet. The apertures provide an opening for each of the flues and are spaced equally around the circumference of the sleeve wall. They may overlap angularly. They, that is the apertures, are angularly sized to have a total angular dimension of approximately one to two circumferences so that there is always at least the equivalent area of one flue open. A forced draft blower is connected to one open end of the cylinder sleeve drawing the gases from the sleeve and discharging them to the smoke pipe. A bypass runs from the top of the combustion chamber to the other open end of the cylinder sleeve providing a path for venting the bypass axially through the sleeve. An automatic damper in the bypass opens when the forced draft blower is not operating to provide a natural draft venting of the combustion chamber. A conventional automatic control delays ignition momentarily after the forced draft blower starts in order to provide pre-ignition purging of the flues and the combustion chamber.

The cycling rotary damper can be applied to a conventional water heater which usually has no forced draft blower nor bypass. A plurality of flues is necessary and a damper in the form of a cylinder sleeve can be used similar to the hot-air furnace. A simpler application would locate the flues in a circle and equidistant from the center of rotation of a horizontal disc-shaped rotary damper having a kidney-shaped aperture and located just above the flues thus opening and closing the flues cyclically. The aperture's arc length is such that it does not start to close off one flue before it starts to open the next flue.

BRIEF DESCRIPTION OF THE DRAWING

The drawing, which when used with the specification will set forth the novelty, utility, and operation of the invention, consists of.

DESCRIPTION OF THE PREFERRED EMBODIMENT

Figure 1:
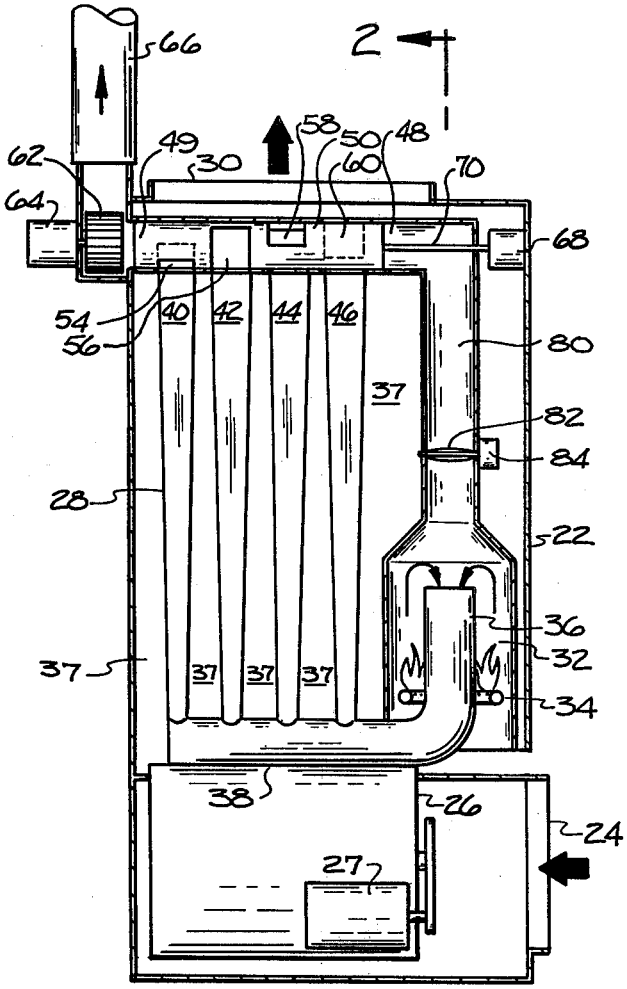
FIG. 1, a diagrammatic, partially sectional, elevational view of a hot air furnace showing the invention, including a cycling rotary damper and a tapered flue.
Figure 2:
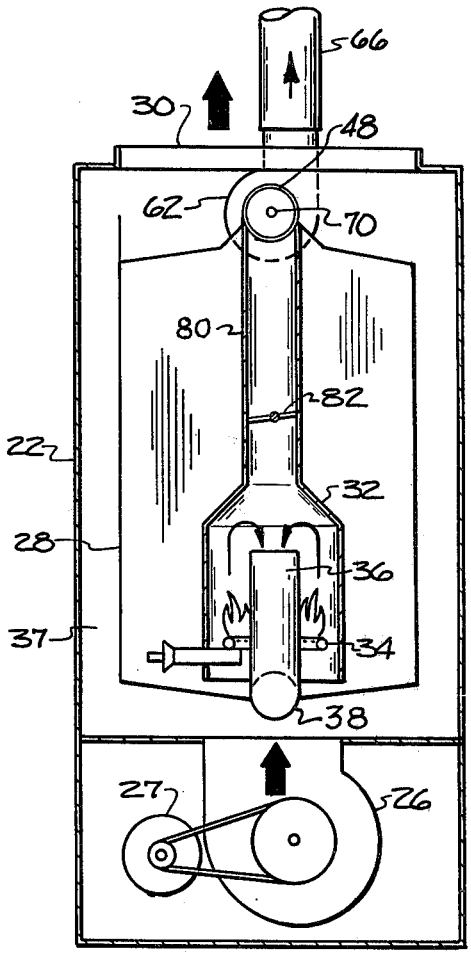
FIG. 2, a diagrammatic view showing a vertical section along line 2—2 of of FIG. 1.

Referring now to FIGS. 1 and 2, a heater 22 is shown in a diagrammatic view with an air inlet 24 connected to a blower 26 driven by a motor 27. The blower 26 is connected to an air passage 37 of a heat exchanger 28. The air passage 37 is connected with an air outlet 30. A combustion chamber 32 is located in the heater 22 and a burner 34 is located in the chamber 32. A bypass damper 82, operated by a motor 84, is located in a bypass flue 80 connected to and above the combustion chamber 32. The bypass 80 connects to an upper manifold 48 which connects to a forced draft blower 62 driven by a motor 64. The blower 62 is connected to a smoke pipe 66. One path from the combustion chamber 32 to the smoke pipe 66 is through the bypass 80, then through the upper manifold 48 and the blower 62. An alternate path from the combustion chamber 32, used when the bypass damper 82 is closed, is through a passage 36 to a lower manifold 38 then through one or more of a plurality of flues 40, 42, 44, and 46 which pass upward through the heat exchanger 28 to the upper manifold 48 then through the forced draft blower 62 to the smoke pipe 66. The foregoing elements in this paragraph are well known in the art.

Figure 4:
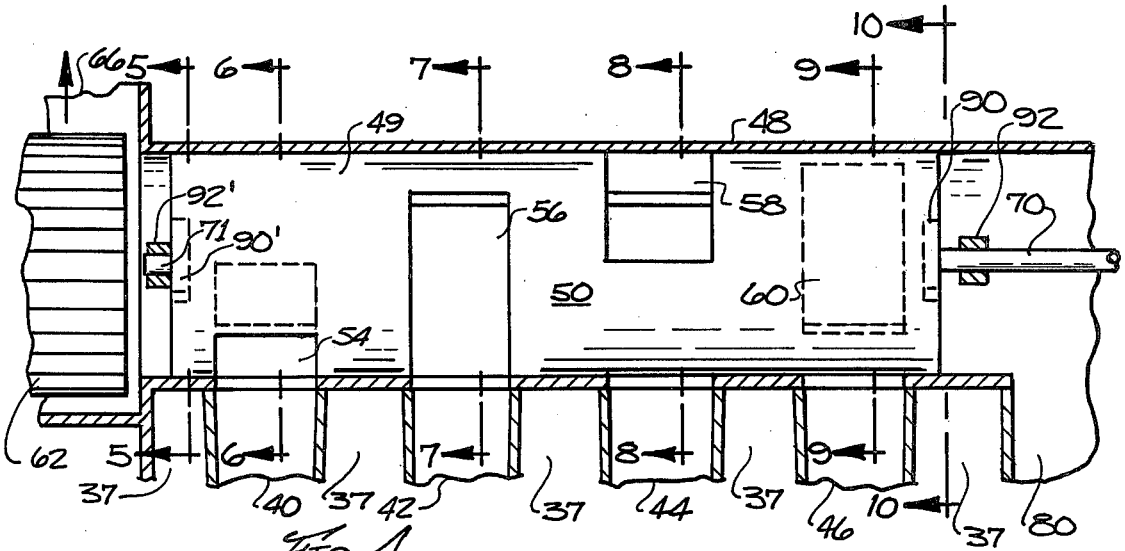
FIG. 4, an enlarged, partially sectional view of the upper part of FIG. 1 showing a side elevation of the cycling damper.
Figure 5:
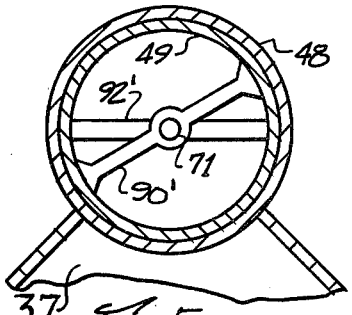
FIGS. 5 through 10, are cross sectional views of the cycling damper along respectively numbered lines of FIG. 4.
Figure 10:
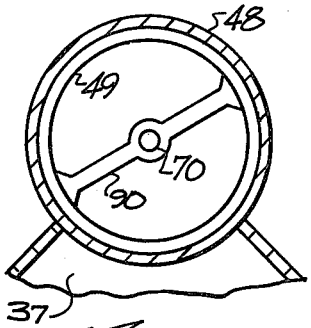

In this preferred embodiment of the invention, referring to FIGS. 1 and 2, the upper manifold 48 is cylindrical and inside of it is a rotating damper 50 comprising a cylindrical sleeve 49 having apertures 54, 56, 58, and 60 through wall of the sleeve 49. The apertures 54, 56, 58, and 60 sequentially become adjacent to upper exit ends of the flues 40, 42, 44, and 46 respectively as the sleeve 49 rotates within the upper manifold 48. The sleeve 49 is a thin walled cylinder of heat resistant material and slightly smaller in diameter than the upper manifold 48. At the position shown in FIG. 1, and in more detail in FIG. 4, the aperture 54 is adjacent to the flue 40 opening it to the upper manifold 48. The aperture 56 is partially adjacent to the flue 42 providing it with a limited connection to the upper manifold 48. The apertures 58 and 60 are not adjacent to the flues 44 and 46 respectively thus closing off connection between the flues 44 and 46 and the upper manifold 48. The sleeve 49 is turned by a damper shaft 70 driven by a gearmotor 68. The damper shaft 70 is fastened to a first spider 90 and rotatably supported by a first support 92 attached to inside of the upper manifold 48 as shown in FIGS. 4 and 10. The first spider 90 is attached inside one end of the sleeve 49. A second spider 90′ is attached inside other end of the sleeve 49 and to a stub shaft 71 which is supported rotatably by a second support 92′ attached to inside of the upper manifold 48 as shown in FIGS. 4 and 5. The flues 40, 42, 44, and 46 have walls which diverge in an upward direction approximately one to three degrees, as shown in FIG. 1.

In operation, the air to be heated enters the heater 22 at the air inlet 24, being drawn in by the blower 26 and blown through the air passage 37 of the heat exchanger 28 and out the air outlet 30 in a conventional manner except for the taper in the flues 40, 42, 44, and 46 which causes the upward moving air particles in the air passage 37 to impinge upon the flues 40, 42, 44, and 46 whose outer walls form converging surfaces in the air passage 37 due to the taper. This impinging causes more air particles to strike the outer walls of the flues 40, 42, 44, and 46 and the additional striking air particles absorb more heat. The impinging action of gases against a surface to increase heat transfer is called wiping. The tapered flues 40, 42, 44, and 46 are one feature of this invention. Another, and independent feature of this invention is the rotating damper 50, which in this embodiment is cylindrical, will now be described as to operation. Still referring to FIGS. 1 and 2, when heat is called for, the bypass damper 82 closes, the forced draft blower 62 operates, purging the flues 40, 42, 44, and 46, the manifolds 38 and 48, the passage 36, the bypass 80, and the combustion chamber 32 for a short period. Fuel is then supplied to the burner 34 and ignited. The forced draft blower 62 then draws heated gases from the combustion chamber 32 through passage 36 and lower manifold 38 which connects with flues 40, 42, 44, and 46. The operation is conventional up to this point.

Figure 3:
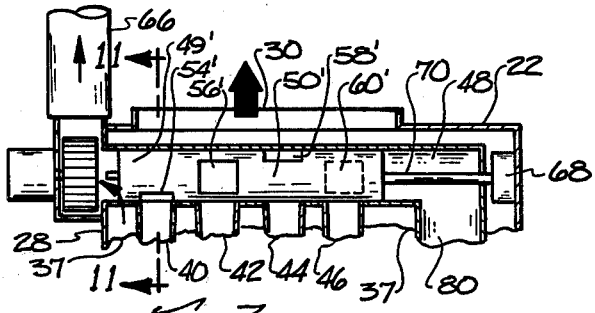
FiG. 3, a diagrammatic view similar to the upper portion of FIG. 1 but showing angularly smaller apertures in the damper.
Figure 6:
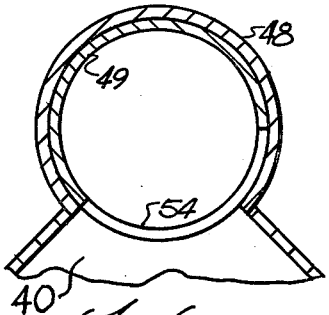
Figure 7:
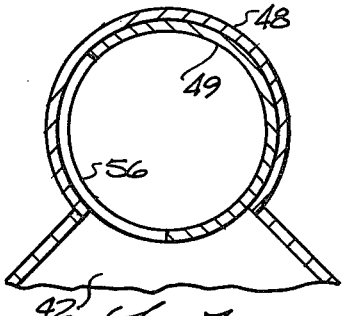
Figure 8:
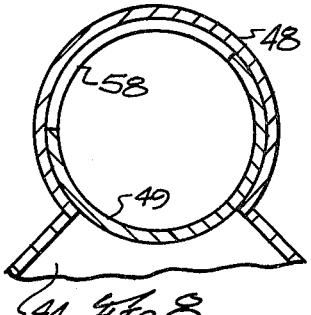
Figure 9:
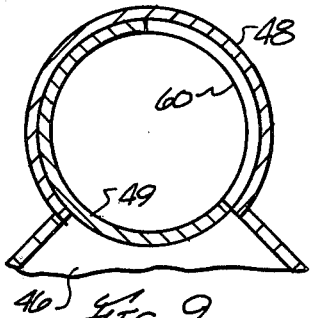

The rotating damper means in this embodiment is the rotating damper 50 with the cylindrical sleeve 49. When the sleeve 49 is in position shown in FIGS. 1 and 4 the hot gases are drawn through the flues 40 and 42 to the upper manifold 48 but momentarily held in the flues 44 and 46 to provide more time for the transfer of heat. Rotation of the damper 50 opens and closes the flues 40, 42, 44, and 46 sequentially. Every flue serves as a holding chamber for a part of each cycle. Referring now to the FIGS. 4 through 10, the flue 40 is open to the upper manifold 48, as can be seen in FIGS. 4 and 6, because the aperture 54 is located adjacent to the flue 40. This allows the gases in the flue 40 to be drawn out and vented through the upper manifold 48 by the forced draft blower 62 then discharged to the smoke pipe 66. While this is going on the flue 40 is being recharged by new hot gases from the combustion chamber 32. As the sleeve 49 keeps turning it eventually closes the flue 40 making it in turn a holding chamber while the hot gases recharge the next flue in like manner. Four or more flues are an efficient number. A heat exchanger with as few as two flues can make use of this invention but with less heat efficiency. Minimum period for venting and recharging, which is the open part of the cycle, is approximately one-sixth of a cycle for a six-flue heater, one-fourth for a four-flue heater, and one-third for a three-flue heater with others in proportion. The maximum open period is approximately twice the minimum. A sleeve 49' in FIG. 3 illustrates the minimum open period for a four-flue heater and the sleeve 49 of FIG. 1 shows somewhat greater open periods. Length of cycle can be varied by changing output speed of the gearmotor 68 which drives the rotating damper 50.

Figure 11:
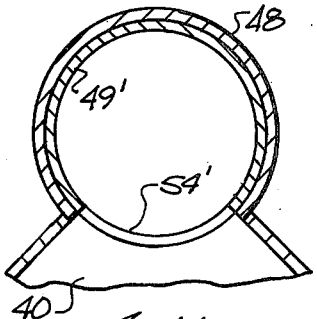
FIG. 11, a cross sectional view of the cycling damper of FIG. 3 along the line 11—11.

FIGS. 3 and 11 show a rotating damper 50' having the sleeve 49' having apertures 54', 56', 58', and 60' which are smaller in angular opening than the embodiment shown in FIGS. 1 and 6 but other elements are similar. As one flue starts to close, another starts to open. This holds the gases in each flue for a greater proportion of the cycle than the damper 50 of FIGS. 1 and 6 in which the equivalent of one and one-half flues are open at any one time. In the FIGS. 3 and 11 arrangement, the equivalent of one flue is open at any one time. The rotating dampers 50, 50', and those of other embodiments may control two, three, four, or more flues. When the rotating damper 50, 50', or others are used to control three or four flues, the angular opening of each aperture preferably ranges from approximately one-third to one-half of the circumference of the sleeve.

Figure 14:
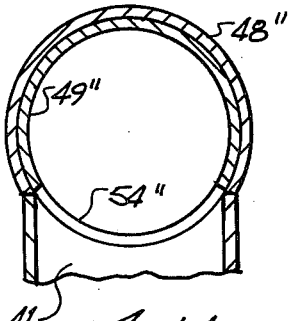
FIG. 14, a cross sectional view along line 14—14 of FIG. 12.
Figure 12:
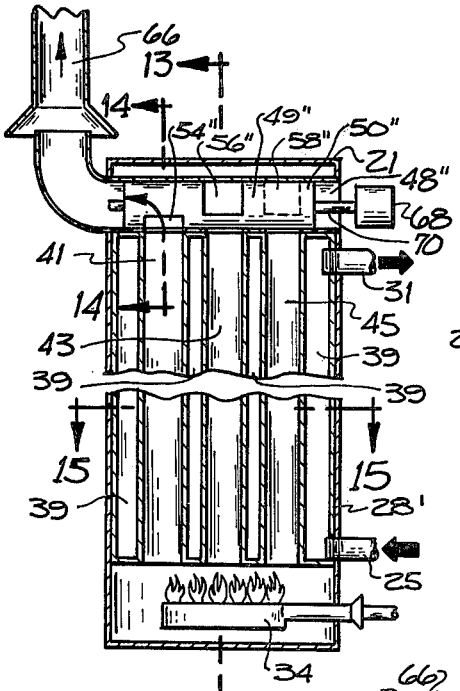
FIG. 12, a diagrammatic, partially sectional view through a water heater showing the cycling damper.
Figure 13:
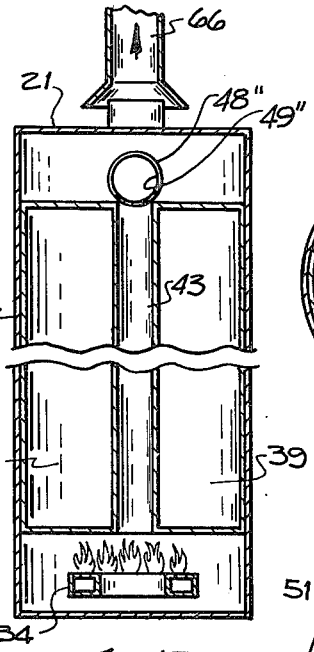
FIG. 13, a diagrammatic view showing a section along the line 13—13 of FIG. 12.
Figure 15:
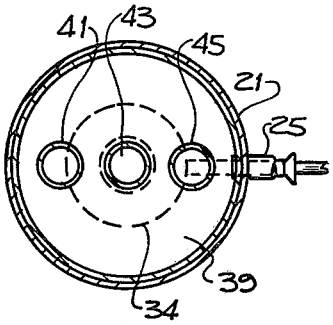
FIG. 15, a cross sectional view along line 15—15 of FIG. 12.

FIGS. 12, 13, 14, and 15 show a rotating damper 50'' applied to a water heater 21 having three flues 41, 43, and 45 through a heat exchanger 28'. A cylindrical sleeve 49'', having apertures 54'', 56'', and 58'', and located within an upper manifold 48'', comprise the rotating damper 50''. In the design shown each of the apertures 54'', 56'', and 58'' subtends approximately one-third of the circumference of the sleeve 49'' as seen in FIG. 14 which shows the aperture 54'' and upper end of the flue 41. The flues 41, 43, and 45 are vertical tubes and are not tapered. A cold water inlet 25 is connected to lower part of a water section 39 of the heat exchanger 28', and a hot water outlet 31 is connected to upper part of the water section 39. In this embodiment there is no combustion chamber, bypass, or forced draft blower. Heat is supplied by a burner 34 in a conventional manner and hot gases pass upward through the flue open at the time, the flue 41 as drawn, into the upper manifold 48'' within the sleeve 49'', thence up a smoke pipe 66, all by natural draft as in conventional water heaters. The invention concerns the rotating damper 50'' and locating the flues 41, 43, and 45 to align with the sleeve 49''. The sleeve 49'' is rotated by a drive shaft 70 which is driven by a gearmotor 68.

Figure 19:
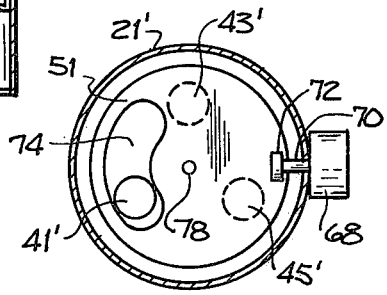
FIG. 19, a sectional view along the line 19—19 of FIG. 18.
Figure 18:
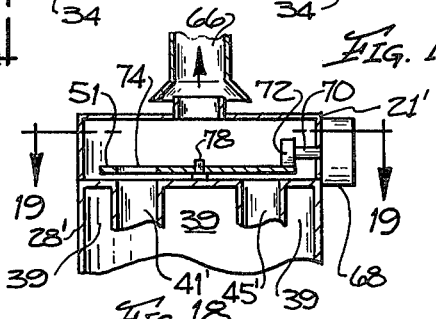
FIG. 18, a diagrammatic, sectional view of the upper part of a water heater showing a modified embodiment of the cycling rotary damper.

FIGS. 18 and 19 show a water heater 21' with a modified rotating damper comprising a disc 51 having a kidney-shaped aperture 74 and rotating about a central pivot 78. A heat exchanger 28' has a water section 39 and a plurality of vertical tubular flues 41', 43', and 45' spaced equally from the pivot 78 and from each other. The kidney-shaped aperture 74 is located a like distance from the pivot 78 so as to be periodically adjacent to and above upper ends of the flues 41', 43', and 45'. The aperture 74 is long enough angularly to start opening one flue as it starts closing its neighboring flue as can be seen in FIG. 19. There is a gear means 72 to enable the drive shaft 70 to drive the disc 51. Other elements in the water heater 21' are similar to corresponding elements in the water heater 21 described in the preceding paragraph.

Figure 16:
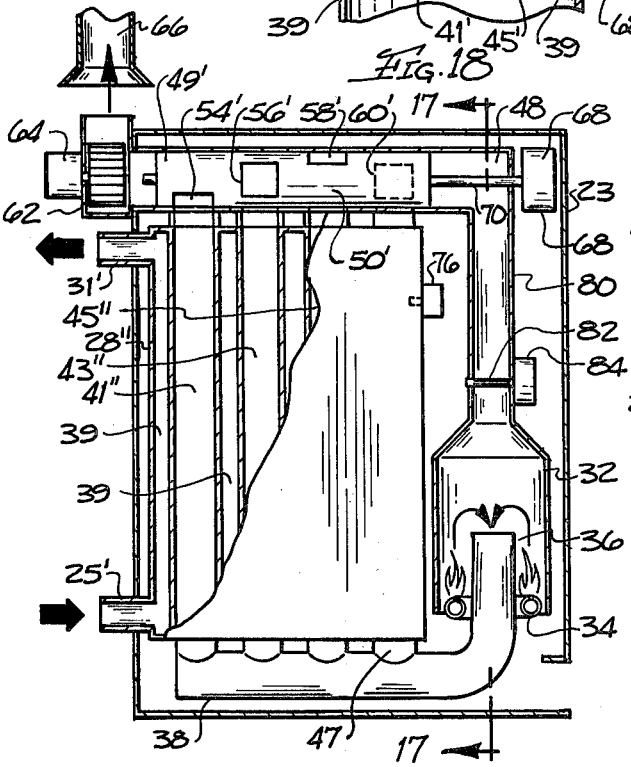
FIG. 16, a diagrammatic, partially sectional view through a hot water furnace showing the cycling damper.
Figure 17:
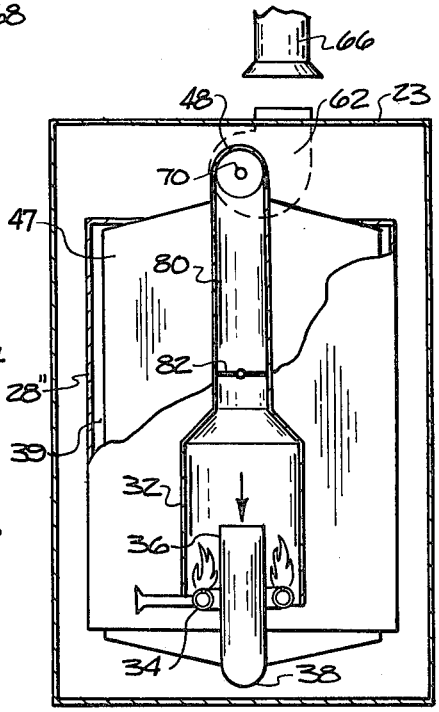
FIG. 17, a diagrammatic, partially sectional view along the line 17—17 of FIG. 16.

An application of a rotating damper 50' to a heater 23 comprising a hot water furnace is shown in FIGS. 16 and 17. A plurality of flues, 41'', 43'', 45'', and 47, are vertical non-tapered passages through a heat exchanger 28'' which contains water to be heated in a water section 39. Cold water enters the water section 39 at an inlet 25' and after being heated, leaves at an outlet 31'. A water temperature control 76 senses temperature in the water section 39. Other elements are similar to those described previously.

Conventional temperature, time, and interlocking fail-safe controls, well known in the art, are used to control the fuel supply, ignition, bypass damper, forced draft blower, and drive for the cycling rotating damper.

Having fully described the invention sufficiently to enable one skilled in the art to construct it, I claim:

1. An improved heat exchanger of a type used in a heater comprising, in combination: means for producing heated gases at base of the heat exchanger; a plurality of vertical flues passing through the heat exchanger carrying the heated gases upward by natural draft; and a smoke pipe above the flues into which the heated gases are discharged; in which the improvement comprises:

a rotating damper means for cyclically opening and closing the flues, the damper means being interposed between the flues and the smoke pipe and having an opening means for cyclically opening and closing the flues in such order that at least one flue, at any one time, is open for venting the heated gases to the smoke pipe and recharging while at least one other flue is closed for temporarily holding the heated gases to provide increased time for the transfer of heat in the heat exchanger; and means for driving the rotating damper means.

2. An improved heat exchanger as recited in claim 1, in which the rotating damper means comprises:

a cylinder sleeve having in its wall an aperture located above each flue, each aperture extending over a partial circumference of the wall of the cylinder sleeve, and the cylinder sleeve having an open end connected to the smoke pipe.

3. An improved heat exchanger of a type used in a heating furnace comprising, in combination: means for producing heated gases; a plurality of flues through the heat exchanger, the flues being connected with the means for producing heated gases; a forced draft blower connected with and downstream from the flues, the forced draft blower drawing the heated gases through the flues; and a smoke pipe connected with and downstream from the forced draft blower; in which the improvement comprises:

a rotating damper means interposed between the flues and the forced draft blower, for sequentially opening and closing the flues in such order that at least one flue, at any one moment, is open for venting the heated gases to the smoke pipe and recharging while at least one other flue is closed to become temporarily a holding chamber for the heated gases to provide increased time in the heat exchanger for the transfer of heat; and means for driving the rotating damper means.

4. An improved heat exchanger as recited in claim 3 in which the rotating damper means comprises a cylinder sleeve having in its wall an aperture located above each flue and extending over a partial circumference of the wall, the cylinder sleeve having an open end opening into the forced draft blower to conduct the heated gases from at least one of the flues, at any particular time, to the smoke pipe.

5. An improved heat exchanger as recited in claim 3 in which the heating furnace comprises a hot air heating furnace having an air blower for moving air to be heated upward through the heat exchanger past an outer wall of the flues.

6. An improved heat exchanger as recited in claim 5 in which an improvement to the flues comprises a flue tapered outward from its bottom to its top so that the angle between its walls is approximately from one to three degrees.

7. An improved heat exchanger as recited in claim 3 in which the means for producing the heated gases comprises a combustion chamber.

8. An improved heat exchanger as recited in claim 3 in which the means for driving the rotating damper comprises a gearmotor.

9. An improved heat exchanger of a type used in a heating furnace comprising, in combination:

a combustion chamber that produces heated gases by burning fuel;

a plurality of flues extending vertically through the heat exchanger, the flues being connected with and downstream from the combustion chamber;

a forced draft blower, connected with and downstream from the flues, having control means for operating the forced draft blower to purge the flues just prior to ignition, then draw the heated gases through the flues while the fuel is burned;

a smoke pipe connected to and downstream from the forced draft blower which vents the heated gases into the smoke pipe;

a bypass from the combustion chamber around the flues to the forced draft blower providing a natural draft path to the smoke pipe when the forced draft blower is not operating;

a bypass damper means for closing the bypass when the forced draft blower is operating;

an air blower means for moving air to be heated through an air passage in the heat exchanger;

in which the improvement comprises:

a rotating cylindrical damper, rotatable on its axis, located horizontally above the flues and interposed between the flues and the forced draft blower transversely across the flues, the cylindrical damper being also interposed, but axially, between the bypass and the forced draft blower, with one open end of the cylindrical damper connected to the forced draft blower for venting and the other open end connected to the bypass, the cylindrical damper having apertures in its sleeve wall, one aperture located above each flue and extending over an arc of such length that a sum of the arcs of all the apertures equals at least one circumference of the sleeve wall, the arcs being equally spaced around the sleeve so that during rotation at least one flue is, at any one moment, open to vent the gases and recharge the flue while at least one other flue is closed to serve as a holding chamber for the gases;

means for driving the rotating cylindrical damper; and means for automatically controlling, in combination, the burning of fuel, the forced draft blower, the bypass damper means, the air blower means, and the improvement comprising the rotating cylindrical damper to conserve fuel safely while providing an equable temperature in a space being heated.

10. A rotating damper means for cyclically holding heated gases in a plurality of flues of a heater, then venting the gases to a smoke pipe and recharging the flues with a new supply of the heated gases, comprising, in combination:

a rotating heat resistant member, located between the flues and the smoke pipe, having aperture means for venting and recharging each flue for approximately one-sixth to two-fifths of a cycle and solid means for closing off said flue making it a holding chamber for remainder of the cycle; and means for rotating the heat resistant member.

* * * * *